US005956559A

United States Patent [19]

Song et al.

[11] Patent Number: 5,956,559

[45] Date of Patent: Sep. 21, 1999

[54] IRREGULAR SHAPE CHANGE OF TUNGSTEN/MATRIX INTERFACE IN TUNGSTEN BASED HEAVY ALLOYS

[75] Inventors: Heung Sub Song; Eun Pyo Kim; Seong Lee; Joon Woong Noh; Moon Hee Hong; Woon Hyung Baek, all of Daejon, Rep. of Korea

[73] Assignee: Agency for Defense Development, Daejon, Rep. of Korea

[21] Appl. No.: 09/032,292

[22] Filed: Feb. 27, 1998

[30] Foreign Application Priority Data

Aug. 12, 1997 [KR] Rep. of Korea ..... 97/38398

[51] Int. Cl.[6] ..... B22F 3/24

[52] U.S. Cl. ..... 419/29; 419/58

[58] Field of Search ..... 419/29, 38, 58

[56] References Cited

U.S. PATENT DOCUMENTS

| | | | |
|---|---|---|---|
| 3,307,982 | 3/1967 | Milligan et al. | 148/133 |
| 3,979,234 | 9/1976 | Northcutt, Jr. et al. | 148/126 |
| 3,988,118 | 10/1976 | Grierson et al. | 29/182 |
| 4,002,471 | 1/1977 | Sarnes et al. | 75/200 |
| 4,762,559 | 8/1988 | Penrice et al. | 75/248 |
| 4,784,690 | 11/1988 | Mullendore | 75/248 |
| 4,938,799 | 7/1990 | Nicolas | 75/248 |
| 5,145,512 | 9/1992 | Spencer et al. | 75/248 |
| 5,248,474 | 9/1993 | Morgan | 419/28 |
| 5,294,269 | 3/1994 | Lee et al. | 148/514 |
| 5,342,573 | 8/1994 | Amano et al. | 419/38 |
| 5,462,516 | 10/1995 | Stuitje et al. | 75/248 |
| 5,722,034 | 2/1998 | Kambara | 419/26 |

OTHER PUBLICATIONS

Heung–Sub Song, et al., "Undulation of W/Matrix Interface by Resintering of Cyclically Heat–Treated W–Ni–Fe Heavy Alloys", Metallurgical and Materials Transactions A, vol. 28A, pp. 485–489 (Feb. 1997).

*Primary Examiner*—Daniel J. Jenkins
*Attorney, Agent, or Firm*—Scully, Scott, Murphy & Presser

[57] ABSTRACT

A method for producing an irregular tungsten/matrix interface in tungsten based heavy alloy is disclosed. The method involves a cyclic heat treatment and resintering at above liquidus temperature for tungsten heavy alloys consisting of 80 to 98 weight % tungsten and remainder of matrix phase. The sintered specimens are cyclically heat treated at above 1000° C. and resintered at liquidus temperature of the matrix phase for one minute to 4 hours at a constant temperature.

6 Claims, 5 Drawing Sheets

20 μm

IRREGULAR SHAPE CHANGE OF TUNGSTEN/MATRIX INTERFACE IN TUNGSTEN BASED HEAVY ALLOYS

BACKGROUND OF THE INVENTION

1. Field of the Invention

The present invention relates to tungsten based heavy alloys, and more particularly to a method for making irregular tungsten/matrix interfaces in tungsten heavy alloys by cyclic heat treatment and resintering.

2. Discussion of the Background

Tungsten heavy alloys consist of greater than 90% by weight of tungsten, and nickel and iron. These alloys are usually manufactured by a liquid phase sintering, a powder metallurgic method, because of high melting temperature of tungsten. Tungsten heavy alloys have a good combination of high density and strength. Therefore, these alloys are widely used for rotors and weight balance, as well as for a penetrator of an armor piercing fin stabilized discarding sabot.

FIG. 1 shows a typical tungsten heavy alloy microstructure.

As shown therein, spherical hard tungsten grains (white portions) of a BCC structure are surrounded by soft matrix phase. So these alloys are one of the metal matrix composites(MMCs) comprising distinct the two phases and interfaces of tungsten/matrix and tungsten/tungsten, respectively. In recent years, it was reported that thermal stresses are induced in the tungsten heavy alloys [1] during heating and cooling, due to the mismatch in the thermal expansion coefficient(TEC) between the tungsten grain and matrix phase. When cooling, tensile and compressive stresses are introduced at the tungsten/matrix interfaces and tungsten/tungsten grain boundaries and vice versa. Therefore, reduction of tungsten/tungsten grain boundary area in heavy alloys can be obtained by a repetitive heating and quenching, which is called a cyclic heat treatment at a usual heat treatment temperature. The result of the cyclic heat treatment is the penetration of matrix between tungsten/tungsten grain boundary, and a drastic increase in impact energy [1]. By increasing the number of heat treatment cycles for fixed total heat treatment time, tungsten/tungsten grain boundary area decreased.

Meanwhile the interface problems in tungsten heavy alloys have long been studied, because the mechanical properties of the alloys are closely related with interface problems. These problems are caused by impurities and morphological change at tungsten / matrix interfaces.

The impurities of sulfur, phosphorus and carbon at the tungsten / tungsten and tungsten / matrix interfaces can be healed by heat treatment or addition of suitable scavengers, such as calcium and lanthanum.

A morphological change in the tungsten/matrix interface was observed in by adding a fourth element, such as Mo and Re. Addition of Mo or Re to the starting W, Ni and Fe powders often resulted in an irregular tungsten grain shape because the dissolution rate between W and Mo or Re into the matrix is different. On the other hand, it is also known that the shape change at the tungsten/matrix interfaces can occur by plastic deformation and post annealing process. In this case, however, recrystallization of tungsten grains and matrix penetration into the tungsten/tungsten interface are inevitable. So it has been known that the irregular tungsten/matrix interfaces cannot be obtained in tungsten heavy alloys without adding a 4th element or applying a plastic deformation.

In the present invention, we developed a new type of irregularity at the tungsten/matrix interface in the tungsten base heavy alloys. To accomplish this object, we evaluated the effect of a cyclic heat treatment, i.e. thermal stress accumulated by the repetitive heating and quenching, and post resintering, on the irregular shape change at the interfaces.

SUMMARY OF THE INVENTION

In accordance to this invention, there is provided a process for producing an irregular tungsten/matrix interface morphology.

For obtaining this object, the present invention provides a new process by cyclic heat treatment, which comprises repetitive heating and quenching, and additional resintering of tungsten base heavy alloys consisting of 80-14 98 weight % tungsten and remainder of nickel, iron and 4th element, such as cobalt and manganese. To induce the thermal stresses in the tungsten heavy alloys, cyclic heat treatment was introduced. Heat treatment was performed at 1100–1300° C. under a flowing nitrogen atmosphere and resintering was also carried out at the same temperature of the sintering under a flowing hydrogen atmosphere for 1 min–4 hrs.

Through the successive processes, the irregular shape change at tungsten/matrix interfaces can be obtained.

BRIEF DESCRIPTION OF THE DRAWINGS

Other objects and aspects of the invention will become apparent from the following description of the embodiments with reference to the accompanying drawings in which.

DETAIL DESCRIPTION OF THE INVENTION

Figure 2:
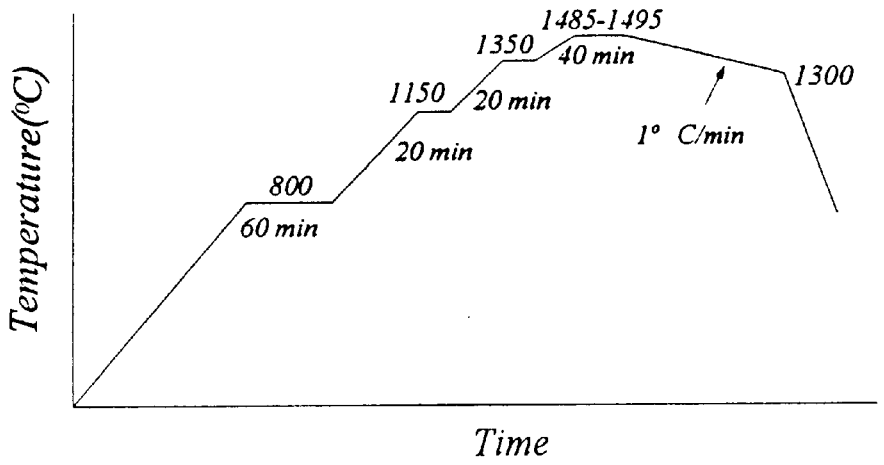
FIG. 2 is a graph illustrating a liquid phase sintering process.
Figure 3:
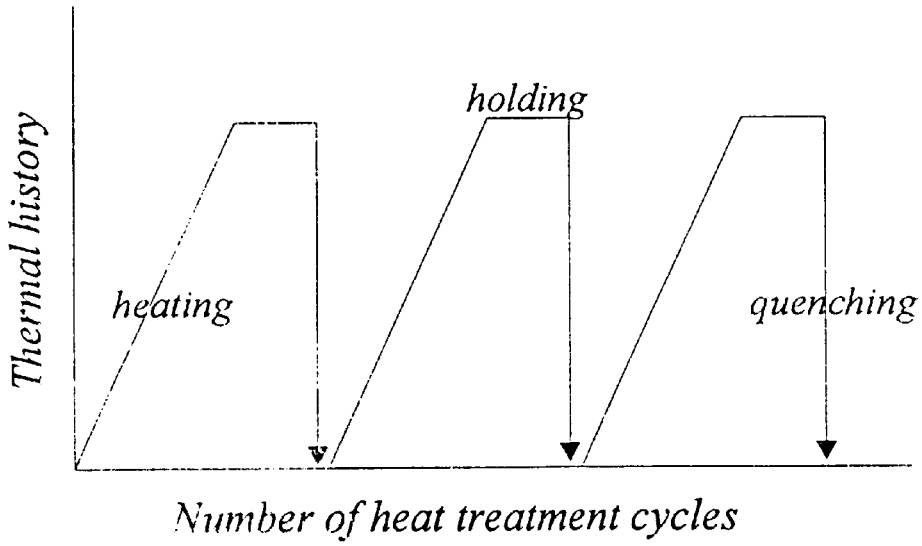
FIG. 3 is a graph illustrating a heat treatment process, which contains repetitive heating and quenching.

The embodiment of the present invention, tungsten heavy alloys are sintered according to FIG. 2, in which they are sintered at 1460–1495° C. with a tungsten content for 40–60 minutes under a flowing hydrogen atmosphere which prevents tungsten powder from being oxidized. And cyclic heat treatment is also carried out as shown in FIG. 3 at 1100° C., and subsequently resintered at the same temperature of previous sintering step.

Figure 4:
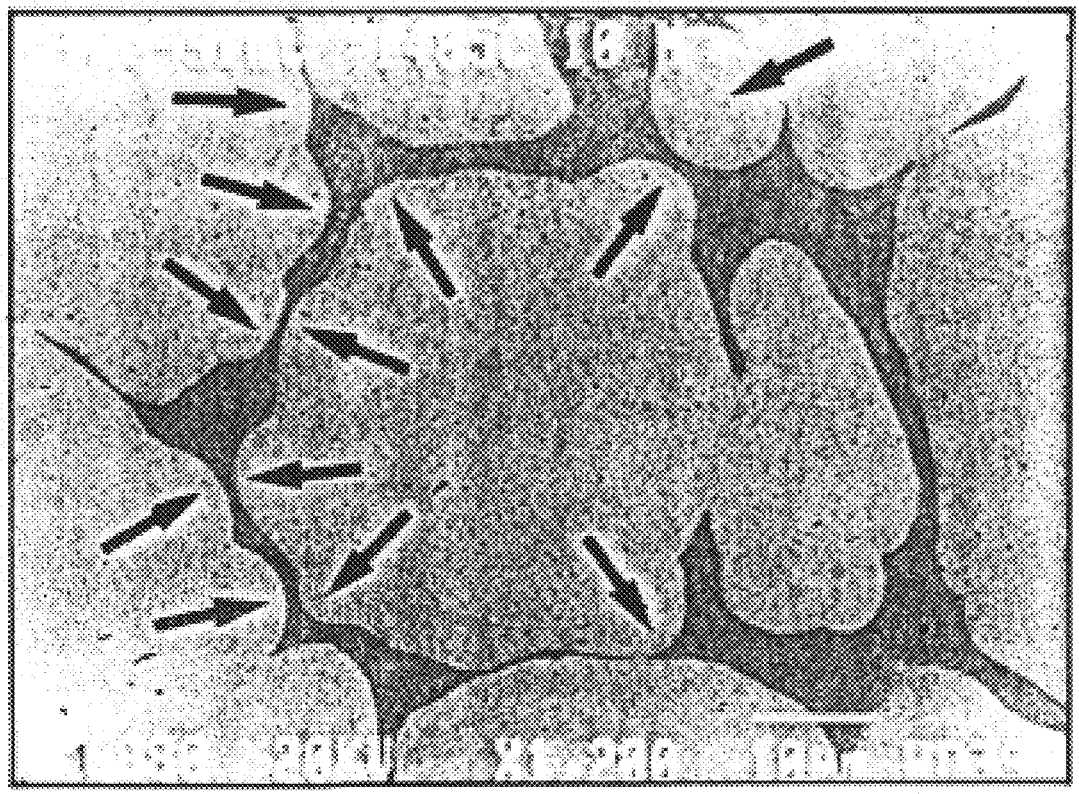
FIG. 4 is a microstructure of 91W-6.3Ni-2.7Fe(wt. %) heavy alloy, sintered at 1485° C. for 40 min, heat treated for 20 cycles and resintered at 1485° C. for 10 min.

By the 20th cyclic heat-treatment and resintering of the 91W-6.3Ni-2.7Fe heavy alloys, morphology of the tungsten/matrix interface is changed from a smooth contour to an irregular shape as shown in FIG. 4. FIG. 4 is quite similar to when Mo or Re is added to a W-Ni-Fe alloys, but its nature is very different from each other.

When the 4th element is added, chemically inhomogeneous regions in a tungsten grain are formed in the alloys, which is due to the different dissolution rate between W and Mo or Re in the matrix. In contrast to these alloys containing a fourth element, the present alloys have no chemical inhomogeneity in the tungsten grains. The irregularity of the tungsten / matrix interface in this invention is therefore related neither to the chemical inhomogeneity nor to the coalescence of solid grains.

It is generally known that thermal stress arises from the TEC mismatch between reinforcement and matrix during cooling in MMCs. Because the TEC of the matrix is 4 times greater than that of the tungsten grain, tensile and compressive stresses must be stored in the matrix and tungsten grains during cooling, respectively. Hence, the greater the number of heat treatment cycles, the higher thermal stresses must be stored in the two phases. Therefore, the thermal stresses resulted from the cyclic heat treatments play a role of driving force [2] for the formation of irregular grain shape at the tungsten/matrix interface when the alloys are additionally resintered.

This type of irregularity in the tungsten/matrix interface is not limited to the W-Ni-Fe heavy alloys, but also applicable to other composite materials, such as W-Ni-Fe-Mn, W-Ni-Fe-Co and W-Ni-Fe-Cu based heavy alloys.

For a better understanding of the present invention, together with other and further objects, advantages, and capabilities thereof, reference is made to the following examples and appended claims with the above description of the invention.

EXAMPLE 1

Compacted powder consisting of 91W-6.3Fe-2.7Fe(by weight %) was sintered at 1485° C. for 40 minutes under a hydrogen atmosphere according to a thermal history as shown in FIG. 2, so as to prepare a specimen for tensile test of ASTM E-8 and impact test specimens. Thereafter, the sintered specimen was heat-treated for 20 cycles at 1100° C. under a flowing nitrogen atmosphere. Here, each heat-treatment took 5 minutes and a water quenching process was applied therebetween. Finally the resultant specimens were resintered for 30 minutes as in the method of FIG. 2.

FIG. 4 shows a microstructure of the above specimen. As shown therein, irregular tungsten/matrix interfaces indicated by arrows resulted from the cyclic heat treatments and resintering of the 91W-6.3Ni-2.7Fe(wt. %) heavy alloy, that was distinctively different from that of the typical heavy alloys.

EXAMPLE 2

Figure 5:
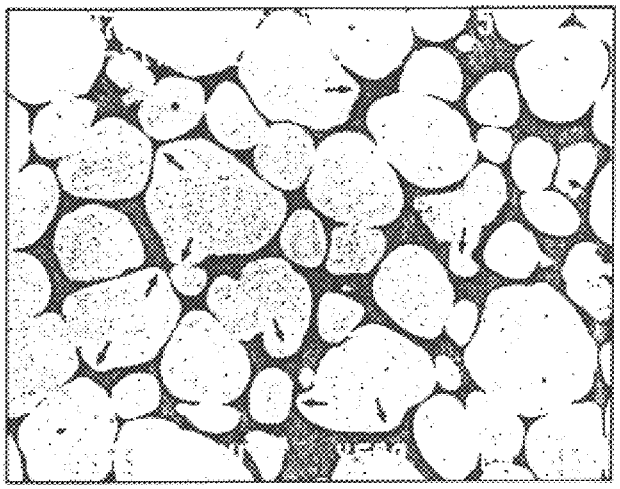
FIG. 5 is a microstructure of 93W-.49Ni-2.1Fe(wt. %) heavy alloy, sintered at 1485° C. for 40 min, heat treated for 5 cycles and re-sintered at 1485° C. for 10 min.
Figure 6:
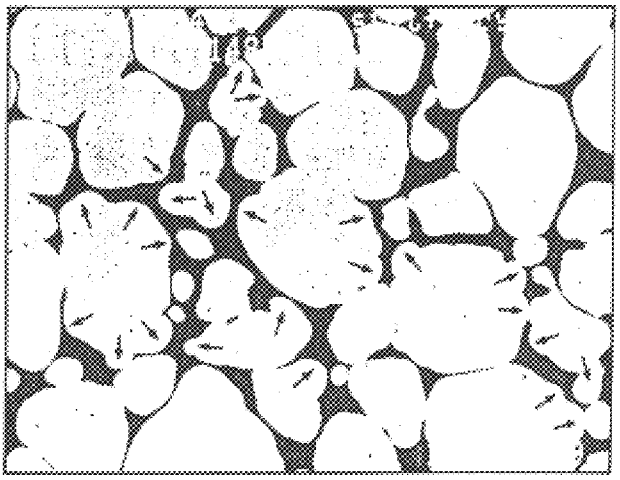
FIG. 6 is a microstructure of 93W-4.9Ni-2.1Fe(wt. %) heavy alloy, sintered at 1485° C. for 40 min, heat treated for 10 cycles and re-sintered at 1485° C. for 10 min.
Figure 7:
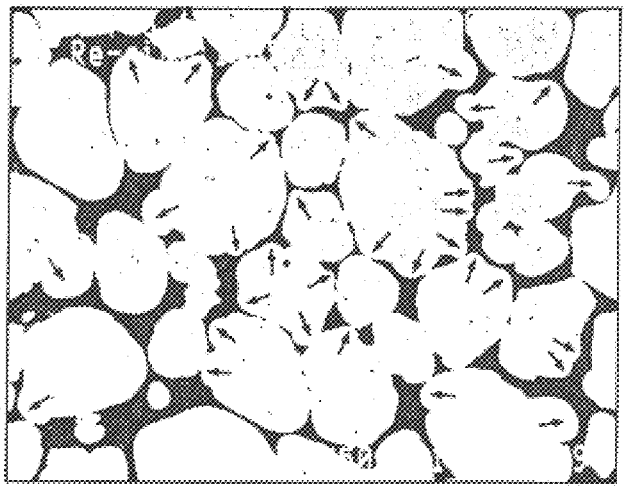
FIG. 7 is a microstructure of 93W-4.9Ni-2.1Fe(wt. %) heavy alloy, sintered at 1485° C. for 40 min, heat treated for 20 cycles and re-sintered at 1485° C. for 10 min.

To investigate the effect of the number of heat treatment cycles on the irregularity of the tungsten/matrix interfaces, a specimen with compositions of 93W-4.9Ni-2.1Fe was prepared and sintered in the same method as shown in FIG. 2. The specimen was sintered at 1485° C. for 40 minutes under a hydrogen atmosphere and heat-treated at 1100° C. under a nitrogen atmosphere for 5 to 20 times. Here, each heat-treating time took 5 minutes. Thereafter, the specimen was resintered under the same condition of the sintering schedule except the holding time of 10 minutes. FIGS. 5–7 respectively show the microstructure of the alloys to which the predetermined number of heat treatment cycles, 5, 10, and 20 times, respectively, and are sintering process is applied in the same condition. As shown therein, it can be seen that the irregularity at the tungsten / matrix interfaces was intensified with the number of heat treatment cycles, which implies that the irregularity at the interfaces was closely related with the thermal stress by the number of the heat treatment cycle.

On the other hand, the specimens for 93W-4.9Ni-2.1Fe were prepared for evaluating the effect of irregularity of the interfaces on the mechanical properties. Tensile tests were carried out in accordance to ASTM E-8 at a speed of 2 mm/min, and impact toughness was also measured by unnotched charpy test, and dimension of the specimens was 7.5×7.5×35 mm. Table 1 shows the result of the tests.

TABLE 1

| | Tensile Strength (MPa) | elongation (%) | Impact Energy (ft. lbs) |
|---|---|---|---|
| A | 937 | 23 | 64 |
| B | 925 | 24.7 | 55 |
| C | 940 | 22.1 | 40 |
| D | 936 | 22.6 | 40 |

A: sintering + heat treatment (1 cycle)
B: sintering + heat treatment (1 cycle) + resintering + heat treatment (1 cycle)
C: sintering + heat treatment (10 cycle) + resintering + heat treatment (1 cycle)
D: sintering + heat treatment (20 cycle) + resintering + heat treatment (1 cycle)

As shown in Table 1, the impact toughness of the specimen decreased with the increase in the irregularity of the tungsten grains, while the tensile properties were unchanged irrespective of the tungsten/matrix interface shape change.

The specimens B, C, and D, of which shapes of the tungsten grains have been changed, show tensile strengths similar to that of the specimen A which is a basic material prepared by a single heat treatment, since the tensile strength is irrelevant to the shape of tungsten grains, and thus fractures are mainly generated in the tungsten grains, thus change of tungsten interfaces is comparatively less effective to the tensile strength. However, the impact toughness thereof was decreased compared to the specimen A, while the shapes of the tungsten grains became undulated. The reason why the impact toughness was decreased is that, as the shapes of tungsten grains undulated, numerous fractures are generated in tungsten grains, and thus fractures of tungsten/tungsten interfaces or tungsten/matrix interfaces are less generated, and cleavage fractures of tungsten grains are comparatively increased.

EXAMPLE 3

Figure 1:
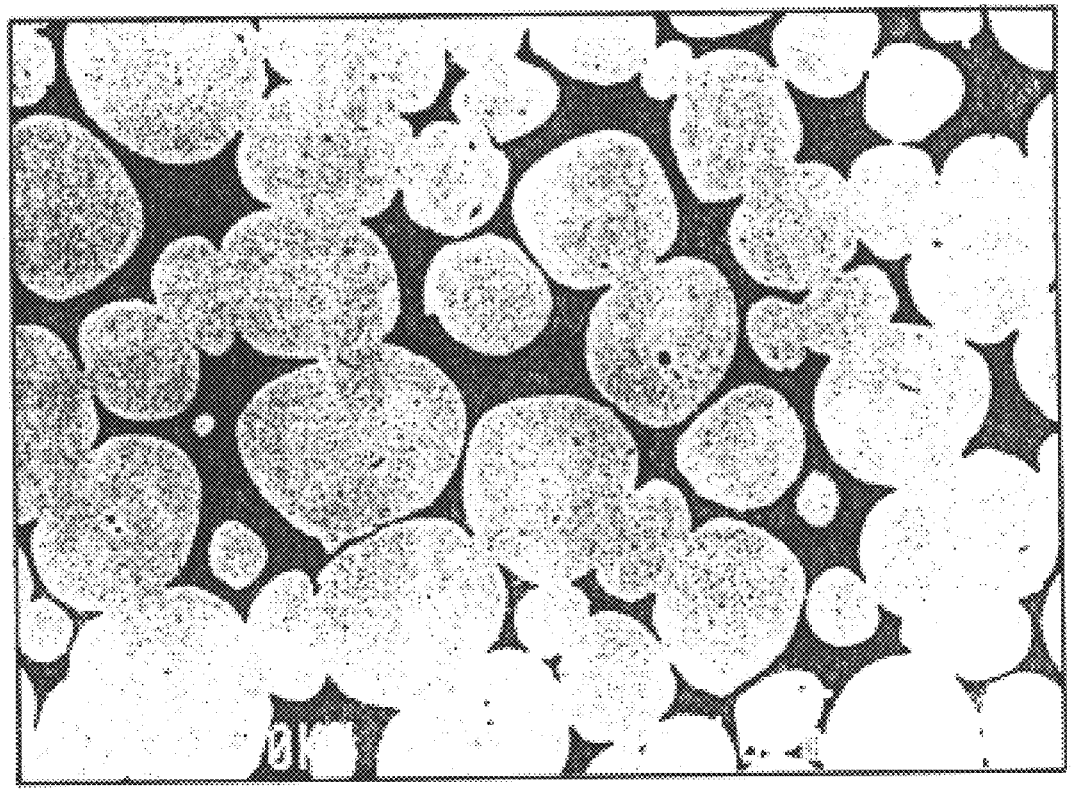
FIG. 1 is a typical microstructure of 91W-6.3Ni-2.7Fe(wt. %) tungsten heavy alloy sintered at 1485° C. for 40 min.
Figure 8:
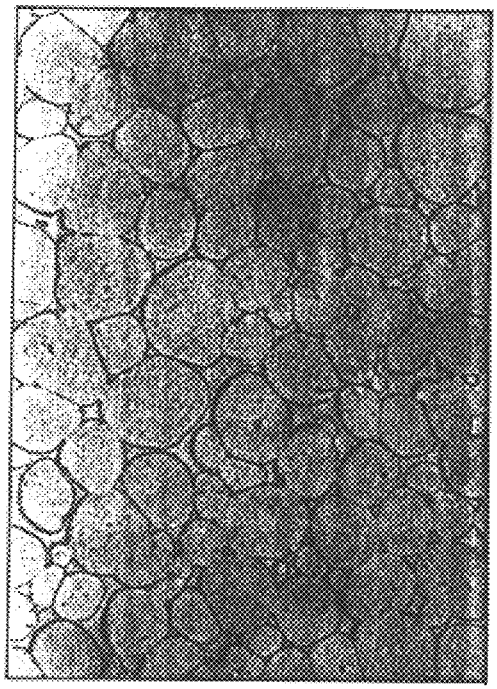
FIG. 8 is a typical microstructure of 95W-3.5Ni-1.5Fe(wt. %) heavy alloy, sintered at 1495° C. for 40 min.

For evaluating the effect of the resintering condition on the irregularity of the tungsten/matrix interfaces, a specimen of 95W-3.5Ni-1.5Fe heavy alloy was prepared. The specimen was sintered at 1495° C. for 40 minutes in the same manner as in FIG. 1, heat-treated for 20 cycles and then resintered at the same temperature of the sintering step. FIG. 8 shows the microstructure of the resultant specimen.

Figure 9:
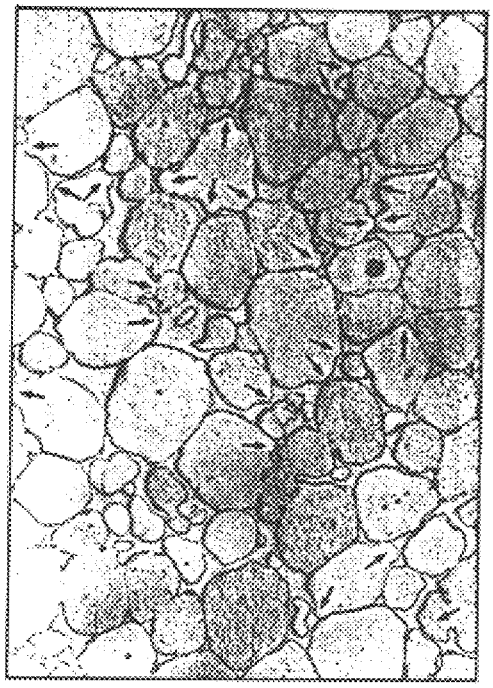
FIG. 9 is a microstructure of 95W-3.5Ni-1.5Fe(wt. %) heavy alloy, sintered at 1495° C. for 40 min, heat treated at 1100° C. for 20 cycles and then re-sintered at 1495° C. for 1 min.
Figure 10:
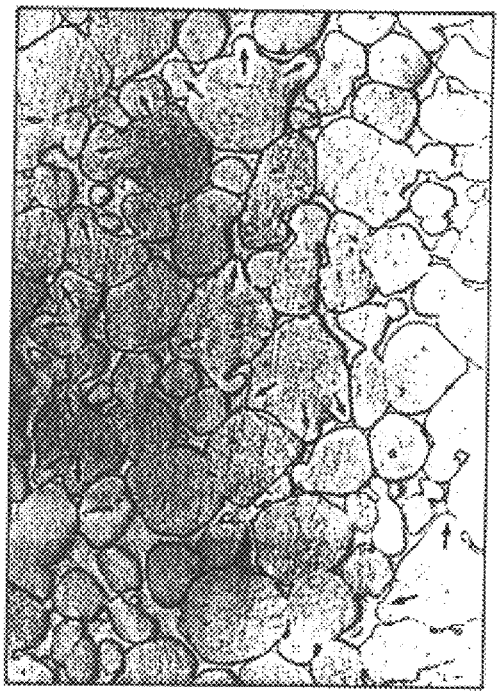
FIG. 10 is a microstructure of 95W-3.5Ni-1.5Fe(wt. %) heavy alloy, sintered at 1495° C. for 40 min, heat treated at 1100° C. for 20 cycles and then re-sintered at 1495° C. for 30 min.
Figure 11:
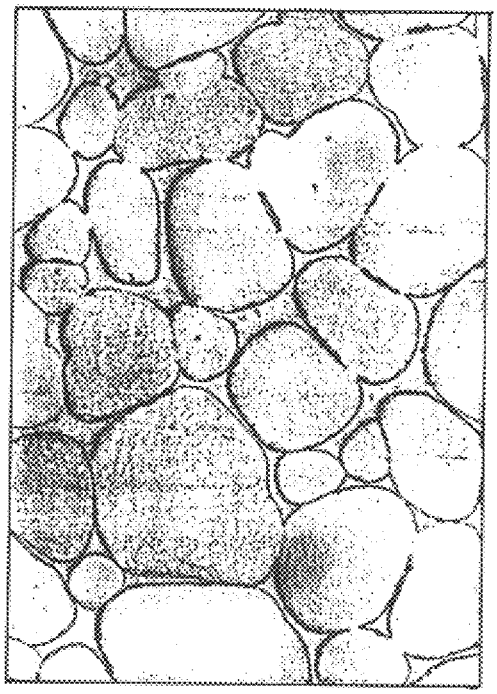
FIG. 11 is a microstructure of 95W-3.5Ni-1.5Fe(wt %) heavy alloy, sintered at 1495° C. for 40 min, heat treated at 1100° C. for 20 cycles and then re-sintered at 1495° C. for 4 hrs.

However, resintering time thereof was 1 min., 30 min., and 4 hr., respectively. FIGS. 9–11 show the variations of the microstructures for the specimens with each resintering time. When the alloys were resintered for a short duration time, the undulation formed at the tungsten/matrix interfaces. And it reduced and finally disappeared as shown in FIGS. 10 and 11. Hence, the irregularity disappeared with grain growth for a long resintering time.

As described above, the present invention provides the method for making irregular tungsten/matrix interfaces without any pretreatment process, such as the addition of a fourth element or a plastic deformation.

It will be apparent to those skilled in the art that various modifications and variations can be made in the method for making irregular tungsten/matrix interfaces in the tungsten heavy alloys of the present invention without departing from the spirit or scope of the present invention. Thus, it is intended that the present invention cover the modifications and variations of this invention provided they come within the scope of the appended claims and their equivalents.

What is claimed is:

1. A heat-treatment method, comprising the steps of:

obtaining a sintered alloy consisting of tungsten of 80–98 wt %, a matrix consisting of at least two components selected from the group consisting of Ni, Fe, Co and Mn, and unavoidable impurities;

repeating heat treatment cycles more than 5 times of heating the resultant sintered alloy within a temperature range of 1000° C.–1300° C. for 5 minutes through 1 hour and then water-quenching or oil-quenching thereof;

resintering the resultant at above liquidus temperature of the matrix for no less than 1 minute; whereby the shape of the tungsten particles are irregularly changed.

2. The method of claim 1, wherein the resintering step is carried out at a temperature above 1435° C.

3. The method of claim 1, wherein the resintering step is carried out under an atmosphere of flowing hydrogen.

4. The method of claim 1, wherein the sintered alloy is a W-Ni-Fe.

5. The method of claim 4, wherein the sintered alloy consists of 80–98 weight % of tungsten, 1–18 weight % of Ni and 0.2–10 weight % of Fe.

6. The method of claim 1, wherein the sintered alloy is W-Ni-Fe-Co, W-Ni-Fe-Cu or W-Ni-Fe-Mn.

* * * * *